US008043138B2

(12) United States Patent
Buckley

(10) Patent No.: US 8,043,138 B2
(45) Date of Patent: Oct. 25, 2011

(54) TOY APPARATUS AND METHOD OF USE THEREOF

(75) Inventor: Mark Buckley, Kent (GB)

(73) Assignee: Origin Products Limited, Berkshire (GB)

( * ) Notice: Subject to any disclaimer, the term of this patent is extended or adjusted under 35 U.S.C. 154(b) by 0 days.

(21) Appl. No.: 12/559,635

(22) Filed: Sep. 15, 2009

(65) Prior Publication Data

US 2010/0184352 A1 Jul. 22, 2010

Related U.S. Application Data

(63) Continuation of application No. PCT/GB2008/000851, filed on Mar. 11, 2008.

(30) Foreign Application Priority Data

Mar. 16, 2007 (GB) ..... 0705049.5

(51) Int. Cl.

| | |
|---|---|
| ***A63H 11/00*** | (2006.01) |
| ***A63H 13/00*** | (2006.01) |
| ***A63H 17/00*** | (2006.01) |
| ***A63H 17/25*** | (2006.01) |

(52) U.S. Cl. ..... 446/280; 446/330; 446/465

(58) Field of Classification Search ..... 446/78, 446/236, 237, 269, 272, 275, 279–285, 288, 446/292, 314, 330, 465

See application file for complete search history.

(56) References Cited

U.S. PATENT DOCUMENTS

| | | | | |
|---|---|---|---|---|
| 1,129,801 | A * | 2/1915 | Hendren | 446/313 |
| 1,388,096 | A * | 8/1921 | Caponic | 446/282 |
| 2,076,627 | A * | 4/1937 | Duley | 446/283 |
| 2,670,956 | A * | 3/1954 | Ganz | 472/61 |
| 4,157,183 | A | 6/1979 | Meyer et al. | |
| 4,678,449 | A * | 7/1987 | Udagawa | 446/136 |
| 2005/0181704 | A1 | 8/2005 | Fischer | |

FOREIGN PATENT DOCUMENTS

| | | |
|---|---|---|
| EP | 1666112 B1 | 10/2007 |
| GB | 2315423 A | 2/1998 |
| GB | 2328623 A | 3/1999 |

OTHER PUBLICATIONS

International Preliminary Report on Patentability (including the Written Opinion) from International Application No. PCT/GB2008/000851, dated Sep. 22, 2009, 6 pages.

* cited by examiner

*Primary Examiner* — Gene Kim
*Assistant Examiner* — Alyssa Hylinski
(74) *Attorney, Agent, or Firm* — Edell, Shapiro & Finnan LLC

(57) ABSTRACT

Toy apparatus is provided including a playbase (22) and at least a first toy member (16) movable relative to said playbase between at least first (36) and second (90) positions via movement means. The movement means are arranged so as to separate the at least first toy member a spaced distance apart from a surface of the playbase in moving said toy member between the at least first and second positions.

21 Claims, 8 Drawing Sheets

TOY APPARATUS AND METHOD OF USE THEREOF

CROSS-REFERENCE TO RELATED APPLICATIONS

This application is a continuation of PCT Application Serial No. PCT/GB2008/000851, entitled "Toy Apparatus and Method of Use Thereof," filed Mar. 11, 2008, which was published as International Publication No. WO 2008/113976 A1 on Sep. 25, 2008, the disclosure of which is incorporated by reference herein in its entirety, which claims priority to British Patent Application No. GB 0705049.5, entitled "Toy Apparatus and Method of Use Thereof," filed Mar. 16, 2007, the disclosure of which is incorporated by reference herein in its entirety.

BACKGROUND OF THE INVENTION

This invention relates to toy apparatus and a method of use thereof.

It is known to provide toy apparatus including a playbase with a toy member movable across the playbase using a control mechanism. An example of such toy apparatus is disclosed in GB2315423. The toy apparatus includes a playbase with control means provided under the playbase surface. The control means includes a magnet which is movable relative to the underside surface of the playbase and this magnet is attracted to a magnet provided in a toy character located on the upper surface of the playbase. Thus, movement of the control means under the playbase causes corresponding movement of the toy character on the upper surface of the playbase due to magnetic attraction, thereby providing the appearance that the toy character is moving on its own. This increases the realism of the toy a user, such as a child.

A problem with the abovementioned toy apparatus is that movement of the toy character is limited to sliding movement across the playbase surface, thereby limiting the range of movement and thus the application of the toy character with respect to the playbase. GB2328623 discloses toy apparatus including articulated control means which allows a toy character to be slid between different heights of a playbase but once again movement of the toy character is limited by the requirement for the toy character to be in contact with the surface of the playbase at all times.

SUMMARY OF THE INVENTION

It is therefore an aim of the present invention to provide toy apparatus which allows a greater range of movement or different movements of a toy member with respect to a playbase.

It is a further aim of the present invention to provide a method of using toy apparatus.

According to a first aspect of the present invention there is provided toy apparatus, said toy apparatus including a playbase and at least a first toy member movable relative to said playbase between at least first and second positions via movement means, and wherein said movement means are arranged so as to separate the at least first toy member a spaced distance apart from a surface of the playbase in moving said toy member between said at least first and second positions.

Thus, in one aspect of the present invention, the toy member is not required to be in contact with a surface of the playbase at all times during movement from a first position to a second position. In one example, a base of the toy member is a spaced distance apart from an upper surface of the playbase during movement between the first and second positions.

This allows a greater range of movements of the toy member and increases the realism of the toy to a user.

The movement means is preferably a mechanical and/or electrical mechanism which does not require direct user interaction with the toy member to move said toy member between said positions. Thus, operation of the toy member is actuated remotely therefrom.

Preferably the at least first toy member is engaged directly or indirectly with a surface or surfaces of the playbase in each of the at least first and second positions. The movement means disengages the toy member from said surface in moving said toy member between said first and second positions.

The at least first and second positions are preferably at spaced apart locations on one or more surfaces of the playbase. Further preferably the first and second positions are substantially horizontally or laterally spaced from each other.

Preferably the movement means physically separates the first toy member from a surface of the playbase, such as for example by lifting, in moving the toy member between the first and second positions.

In a preferred embodiment the at least first toy member is brought into engagement with at least a second toy member in moving from a first to a second position. Preferably the first toy member is in the form of a human character, such as a horse rider and the second toy member is in the form of an animal, such as a horse. The horse rider can be moved into engagement onto the back of the horse, as if the horse rider had mounted the horse.

Preferably the at least second toy member is movable with respect to the playbase surface. The second toy member can be moved with respect to the playbase surface with or without the first toy member engaged thereto. Movement of the at least second toy member can be independent of the movement of the at least first toy member.

The at least second toy member can be moved, at least in part, via the movement means. Alternatively, further movement means can be provided to allow movement of the at least second toy member.

Preferably actuation of the movement means for a first pre-determined time period or for a pre-determined distance allows movement of the at least first toy member between the first and second positions, and continued actuation of the movement means beyond said first pre-determined time or distance allows movement of the at least second toy member.

Reverse movement of the first and/or second toy members can be achieved by moving the movement means in a reverse direction in one example.

Preferably the movement means engages, directly or indirectly, via engagement means with the at least first and/or second toy members to move said toy member between the first and second positions.

The engagement means can include any suitable engagement means, such as one or more clips, ties, inter-engaging members, friction fit and/or the like. In a preferred embodiment the engagement means includes magnetic means.

Preferably the engagement means are such that engagement and/or release of the movement means with the toy member requires no direct manual actuation, thereby giving the appearance that the toy member is moving on its own accord.

In one embodiment magnetic means can be associated with the movement means and magnetic means of an opposite polarity can be associated with the at least first toy member, thereby allowing releasable engagement between the magnetic means of the movement means and the toy member.

Preferably the same or further magnetic means are associated with the at least first toy member, the same or further magnetic means releasably engaging with magnetic means associated with the at least second toy member. The same or further magnetic means of the first toy member are typically of opposite polarity to the magnetic means of the second toy member to allow magnetic attraction therebetween.

Preferably the magnetic attraction between the first and at least second toy member is substantially greater than the magnetic attraction between the first toy member and the movement means. As such, once the first toy member is moved within a pre-determined distance of the second toy member via the movement means (i.e. when the toy members are sufficiently close so that the magnetic field/attraction of the second toy member is greater on the first toy member than the magnetic field/attraction on the first toy member), the first toy member moves into engagement with the second toy member and releases engagement with the movement means.

The first and further magnetic means provided in the at least first toy member are typically a spaced distance apart.

In one embodiment the movement means moves the at least first toy member substantially through at least part of an arc of a circle in moving said member between said at least first and second positions.

Preferably guide means are provided on the playbase and at least part of the movement means are movable in or with respect to the guide means to guide the movement of the movement means with respect to the playbase (i.e. through one or more pre determined movement paths).

Preferably the guide means is in the form of a slot and part of the movement means is movable in said slot.

Preferably the guide means is shaped in the form of at least part of an arc of a circle.

Preferably the guide means are associated with a side wall of the playbase.

Preferably the movement means includes at least one arm member which is pivotably or rotatably mounted on or adjacent the playbase or pivotably or rotatably movable relative to said playbase.

In one embodiment the arm member is pivotably or rotatably mounted to or adjacent the playbase via a cog or gear mechanism. A cog or gear mechanism provided on the arm member typically movingly engages with a cog or gear mechanism provided on the playbase. Teeth provided on the cog or gear mechanism on the arm member can engage with complementary teeth provided on the cog or gear mechanism on the playbase.

Preferably the movement means further includes a movable belt and movement of said belt causes movement of the cog or gear mechanism on the playbase and/or the arm member.

The movable belt is typically a substantially continuous belt which rotates in a clockwise or anti-clockwise direction.

Preferably rack means provided on the movable belt engages with a cog or gear mechanism associated with the arm member. Movement of the belt causes movement of the rack means which in turn causes movement of the cog or gear mechanism and the arm member.

Movement of the movable belt and/or movement means can be powered using electrical means, such as via mains power supply, battery supply and/or the like. Alternatively, or in addition, movement of the movable belt and/or movement means can be driven via mechanical means or manually.

Preferably actuation of the movement means is at least partially caused by movement of the playbase across a surface. One or more wheels, rollers and/or ball bearings can be associated with a lower surface of the playbase and movement of said wheels, rollers and/or ball bearings across the surface can drive movement of the movement means. For example, a shaft can be associated with one or more of the wheel members and rotation of the shaft can drive rotation of the one or more cog or gear mechanisms.

Preferably user actuation means are provided to allow user selection for actuation of the movement means, thereby allowing user control for determining whether the first toy member is moved between the first and second positions.

The user actuation means typically moves the cog or gear mechanism of one or more of the arm member, movable belt and/or wheel members between engaged and disengaged positions with the other of the arm member, movable belt and/or wheel members. In the engaged position, two or more elements of the movement means are connected to allow actuation of the movement means. In the disengaged position, two or more elements of the movement means are disconnected, thereby preventing actuation of the movement means.

The user actuation means are preferably resiliently biased to a disengaged position. The resilient biasing means can include a spring, spring material and/or the like.

In a preferred embodiment the user actuation means is in the form of a depressable button. Depression of the button by a user moves a cog mechanism driving the movable belt into engagement with the shaft of the wheel members, such that rotation of the wheel member rotates the cog mechanism, thereby driving the movable belt.

The arm member is preferably pivotably mounted at a first end thereof and the engagement means, such as the magnetic means for example, are located at or adjacent a second or opposite end thereof. In one embodiment support means are provided at the second end of the arm member and the support means protrudes through the slot forming the guide means. Magnetic means associated with the support means can engage with the at least first toy member provided on the playbase.

A second cog or gear mechanism can be associated with the aim member to allow movement of the toy member between two or more different orientations relative to the arm member or playbase during engagement of the toy member with the movement means. Preferably movement of the toy member between the two or more different orientations takes place on moving the toy member between the first and second spaced apart positions on the playbase. For example, in the different orientations, a front surface of the toy can face different directions.

A further cog or gear mechanism can be associated with the playbase to allow inter-engagement between the second cog or gear mechanism of the arm member. The second cog or gear mechanism of the playbase is typically located at one or more pre-determined positions with respect to the guide means to allow change of orientation of the toy member as the arm member moves relative to the guide means.

In one embodiment positioning means a e provided on the playbase to position the first and/or second toy members in a correct position to allow movement of the members on the playbase.

The positioning means are preferably provided at a first position to position at least part of the first toy member in a required orientation to allow engagement with a second toy member in the second position. For example, in the embodiment where the first toy member is a horse rider, the positioning means positions the legs of the rider so that they can engage in a required orientation with the back of a second toy member in the form of a horse in the second position.

Preferably the at least first and/or second toy members can include one or more articulated parts.

In one embodiment a housing can be associated with the playbase. The housing can include a top, one or more side walls and/or end walls. The housing can be arranged so that actuation of the movement means causes at least part of one or more walls of the housing to move. A catch mechanism can be provided to move said walls. Thus, for example, the catch mechanism can be actuated to move said walls when at least part of the movement means is brought into engagement with the catch mechanism (i.e. release of the catch mechanism upon actuation of the same causes one or more of the walls of the housing to move).

In one embodiment a rotatable element is provided on the playbase to allow the first toy member or a further toy member to be rotated on said playbase. The rotatable element can be caused to rotate on movement of said movement means.

In one embodiment the first and/or second toy member includes one or more articulated parts and movement of said one or more articulated parts causes movement of a further part of the first and/or second toy members. Movement of the one or more articulated parts can be associated with movement of the movement means in one embodiment.

According to a second aspect of the present invention there is provided a method of using toy apparatus, said toy apparatus including a playbase and at least a first toy member, said method including the steps of actuating movement means for moving the at least first toy member between at least first and second positions relative to said playbase, and wherein said movement means are arranged so as to separate the at least first toy member a spaced distance apart from a surface of the playbase in moving said toy member between said at least first and second positions.

According to a further aspect of the present invention there is provided toy apparatus, said toy apparatus including a playbase and at least a first toy member is movable relative to said playbase between at least first and second spaced apart positions via movement means, and wherein said movement means are arranged such that on movement of the toy member between said first and second positions, the orientation of the toy member is moved between or through at least first and second different orientations.

According to a yet further aspect of the present invention there is provided toy apparatus, said toy apparatus including a playbase and at least a first toy member movable relative to said playbase between at least first and second positions via movement means, and wherein at least a second toy member is provided on said playbase and said movement means are arranged to move the at least first toy member into engagement with the at least second toy member.

According to a yet further aspect of the present invention there is provided toy apparatus, said toy apparatus including a playbase and at least a first toy member movable relative to said playbase between at least first and second positions via movement means, and wherein at least a second toy member is provided on said playbase and said movement means also moves said second toy member between at least first and second positions.

According to further independent aspects of the present invention there is provided a method for using the toy apparatus in any manner described herein.

The movement means can move the second toy member substantially simultaneously to movement of the at least first toy member or the second toy member can be moved on substantially continuing movement of the movement means after movement of the first toy member.

BRIEF DESCRIPTION OF THE DRAWINGS

An embodiment of the present invention will now be described with reference to the accompanying figures, wherein.

DETAILED DESCRIPTION OF THE INVENTION

Figure 1A:
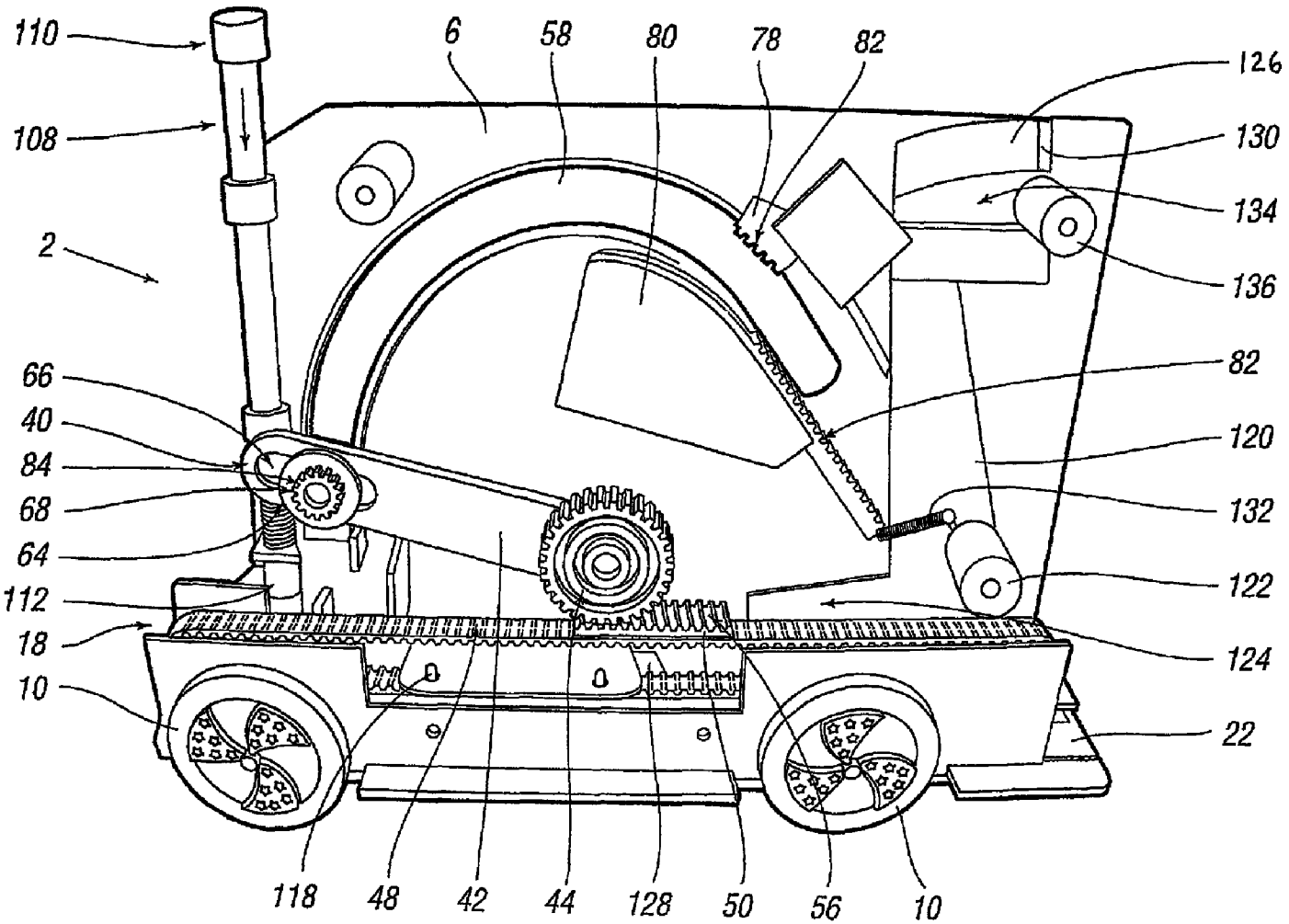
FIGS. 1*a* and 1*b* illustrate a rear view and front view respectively of toy apparatus according to an embodiment of the present invention.

Referring to the figures, there is illustrated a toy apparatus in the form of a horse box 2. The outer cover or housing 3 of the horse box in FIGS. 1-3*b* has been removed to reveal a playbase having a base 4, rear wall 6 and front wall 8. The base 4 protrudes outwardly of front wall 8 to form at least part of the interior of the horse box in use. Wheels 10 are located on the front and rear sides 12, 14 of base 4 to add to the realism of the appearance of the horse box 2.

Figure 5A:
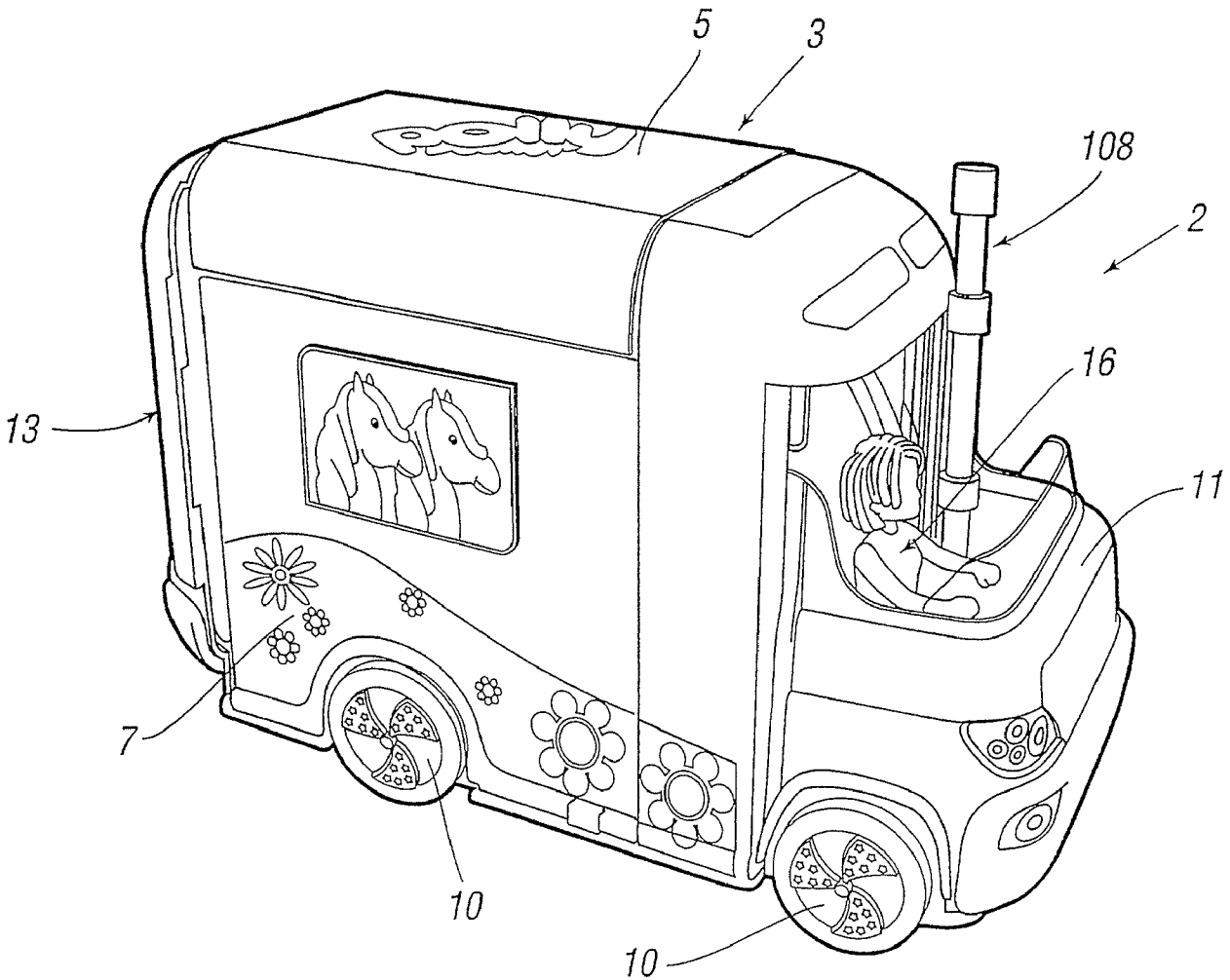
FIGS. 5*a* and 5*b* illustrate a perspective view of a housing associated with the playbase in closed and open positions respectively.
Figure 5B:
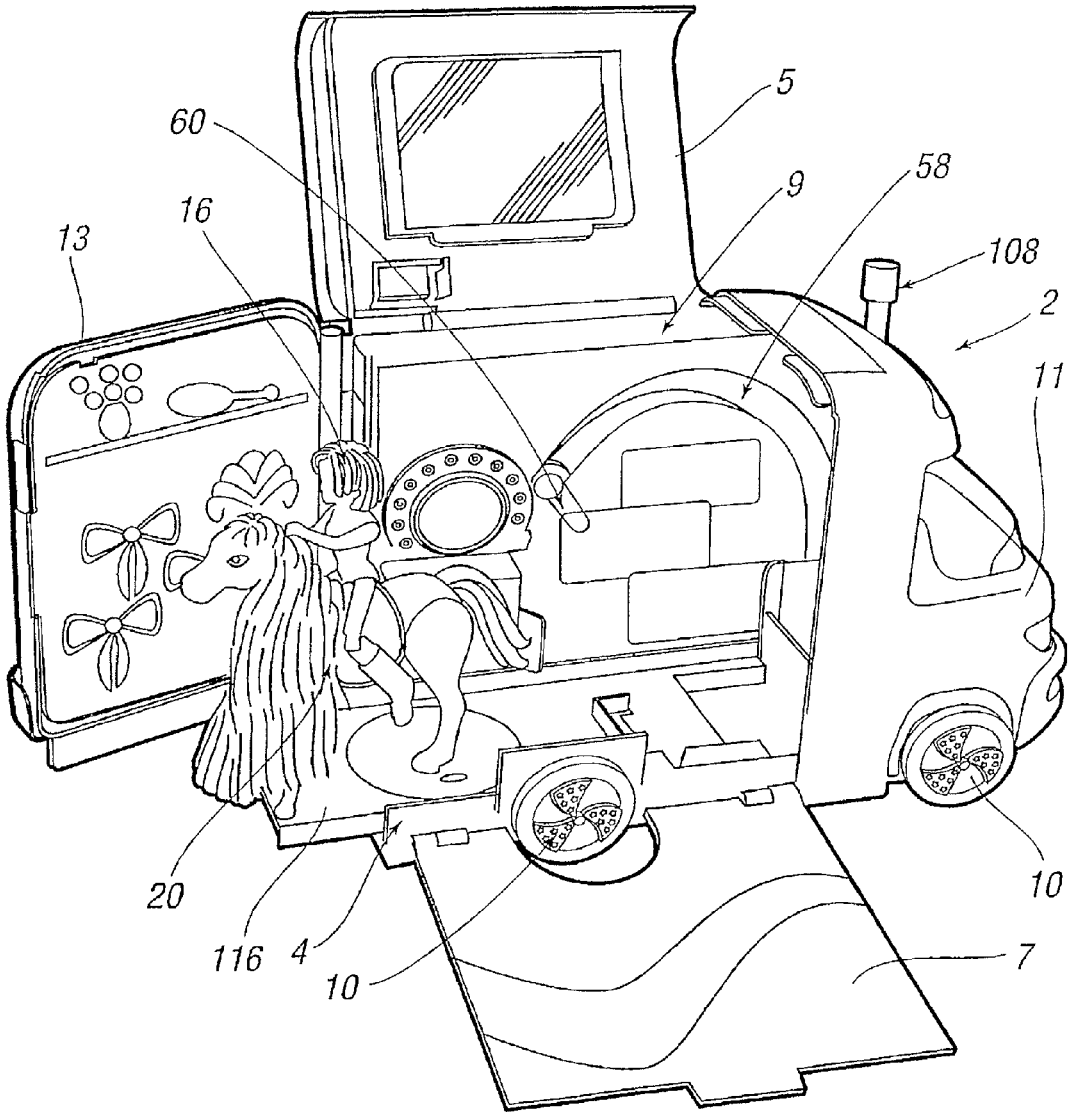

FIGS. 5*a* and 5*b* illustrate the housing 3 located with the playbase. The housing includes a top wall 5, side walls 7, 9, a front wall 11 and a rear wall 13. Top wall 5, side wall 7 and rear wall 13 are movable between closed and open positions to allow access to the playbase provided within the housing. The mechanism via which the walls can be moved between closed and open positions will be described in more detail below.

Figure 1B:
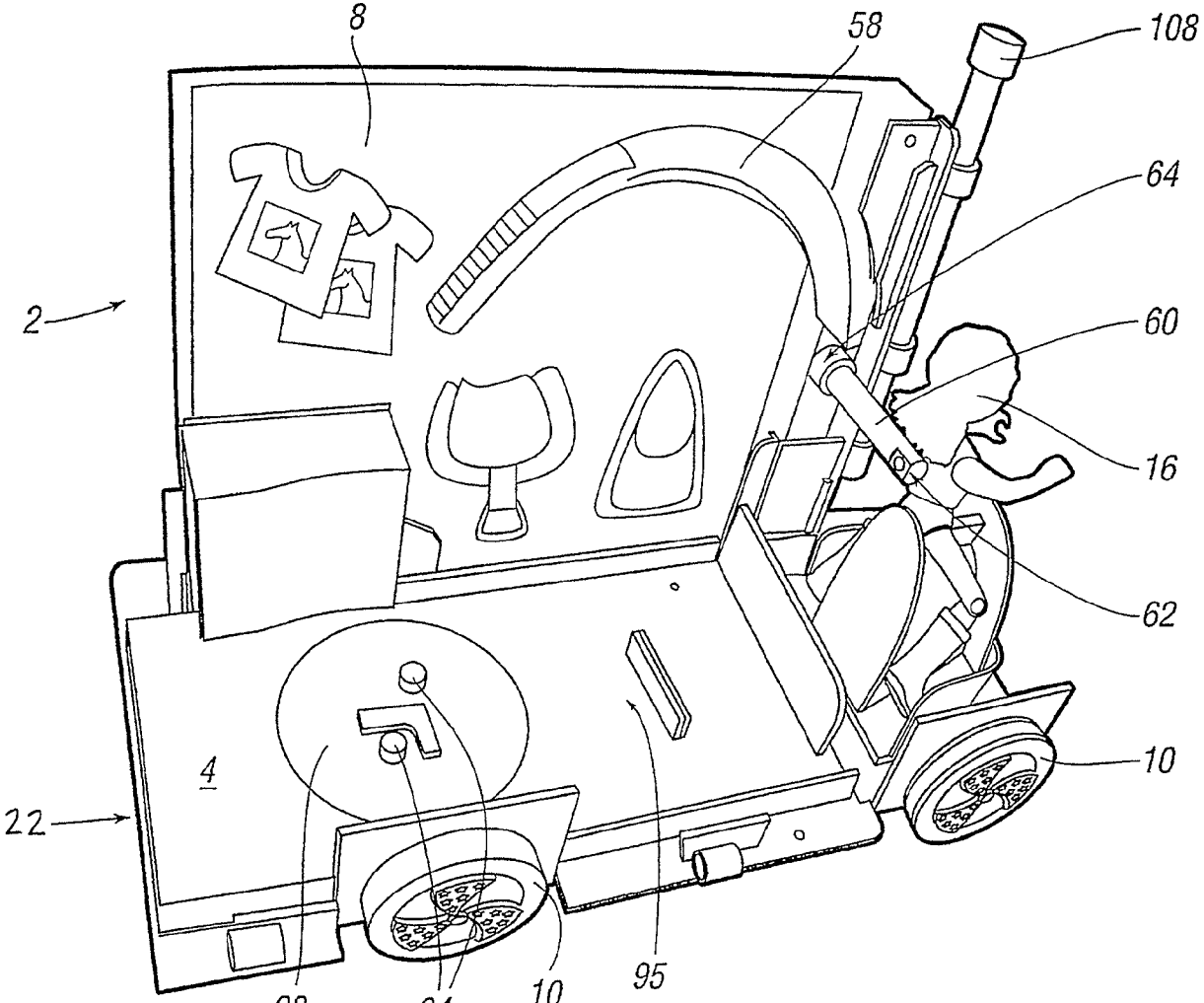
Figure 2:
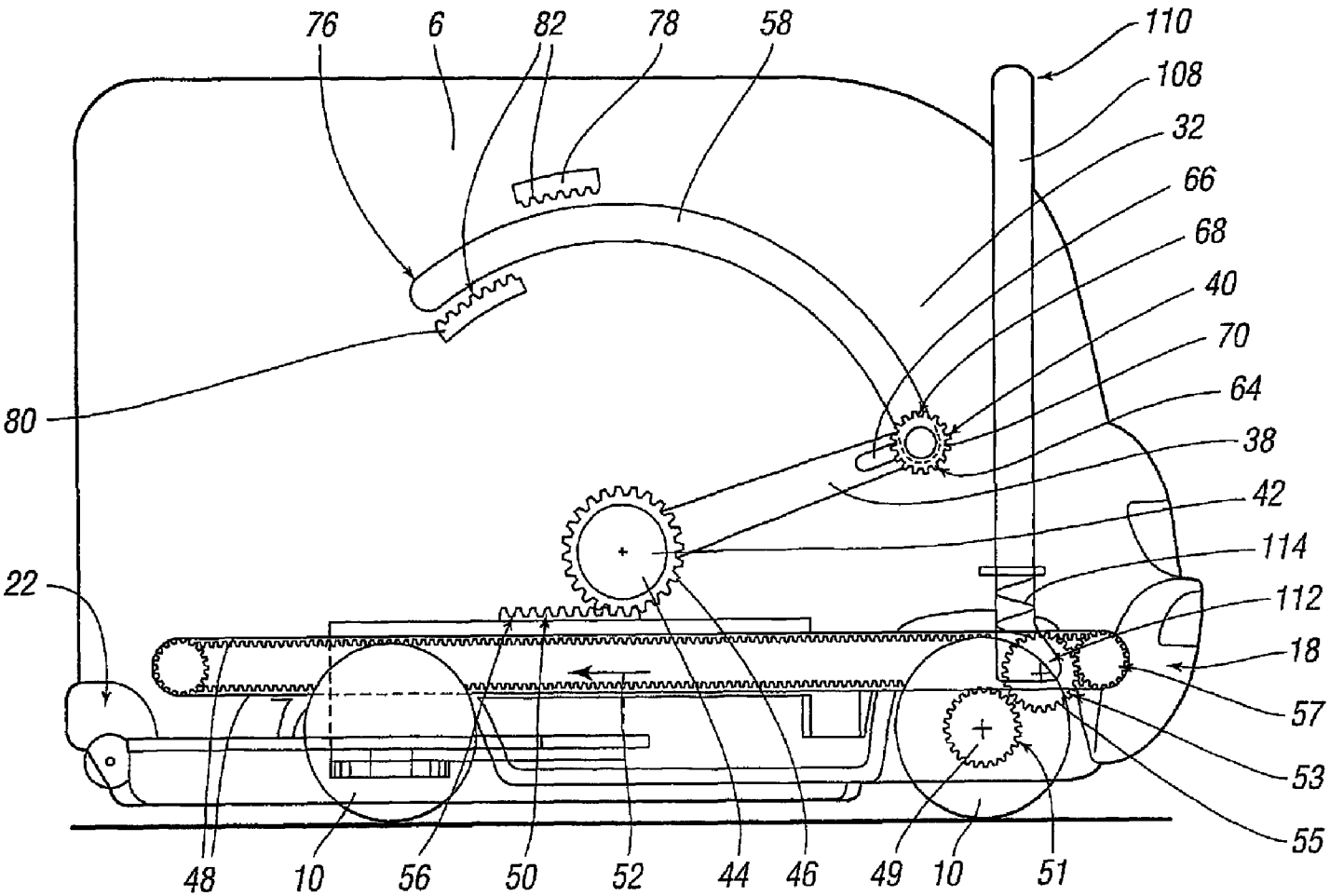
FIG. 2 illustrates a more simplified rear view of the toy apparatus in FIG. 1*a;*
Figure 3A:
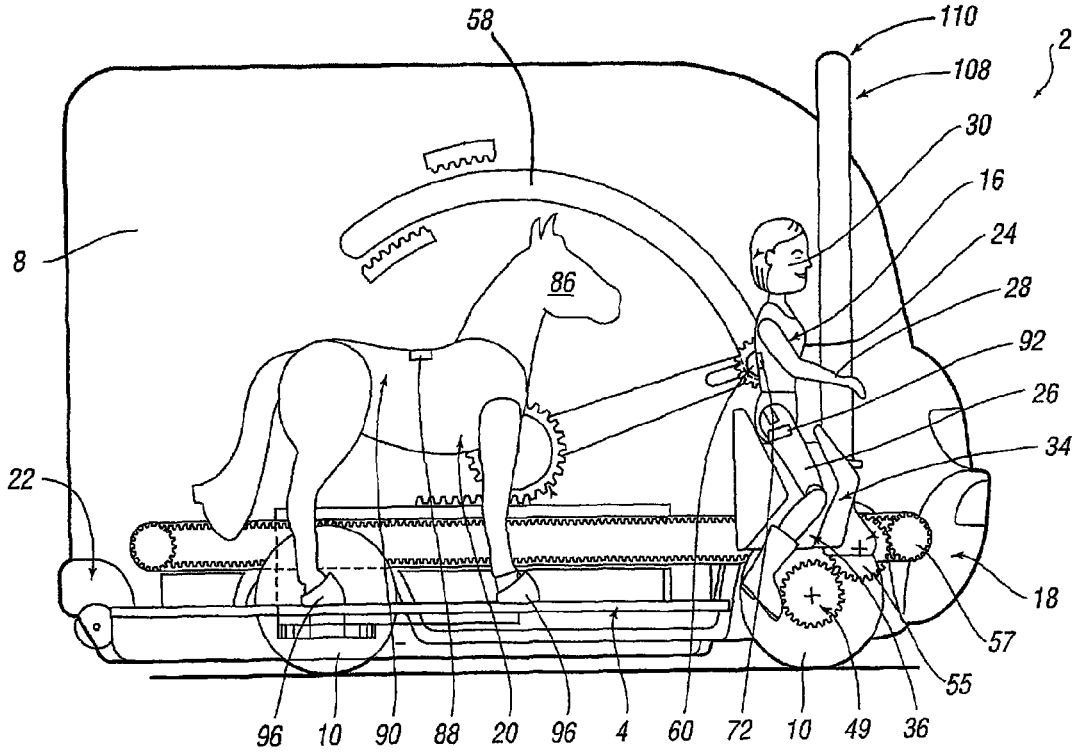
FIGS. 3*a* and 3*b* illustrate a more simplified front view of the toy apparatus in FIG. 1*b* in a first position and an intermediate position respectively.

A first toy member in the form of a human doll 16 is used with the horse box 2 and is moved in accordance with the present invention from a first seated position, as shown in FIGS. 1*b* and 3*a*, wherein doll 16 is located adjacent a front 18 of the playbase as if the doll is driving the horse box 2, to a second seated position, as shown in FIG. 5*b*, wherein the doll 16 is mounted on a second toy member in the form of a horse 20 located on base 4 towards a rear 22 of playbase.

The doll 16 includes a body portion 24, legs 26, arms 28 and a head 30. The legs 26, arms 28 and head 30 typically are provided with movable joints, thereby allowing the same to move relative to the body portion 24. This increases the realism of the doll to the user.

Movement means 32 are provided on the playbase to move doll 16 from the first seated position to the second horse back position. The movement means 32 does this by actually lifting and moving doll 16 from the first position, the movement having both lateral and vertical elements, thereby separating the doll 16 from the playbase, and relocating doll 16 in the second position. In the first position, the legs 26 of doll 16 are engaged either side of a seat 34. The seat 34 has a recess 36 on the top and sides in which the bottom of body portion 24 and legs 26 are located respectively.

The movement means 32 is located largely behind rear wall 6 and base 4, thereby hiding the same from a user playing with the toy apparatus. The movement means 32 includes an elongate arm member 38 having a first end 40 and a second end 42. A cog 44 having teeth 46 around a peripheral edge thereof is provided at second end 42 and is mounted on a rack 50 provided on a movable belt 48. Rack 50 has a plurality of teeth 56 located on an upper surface thereof. The teeth 56 engage with complementary teeth 46 on cog 44. Movement of movable belt 48 causes movement of rack 50 which in turn drives the movement of arm member 38.

More particularly, belt 48 is a substantially continuous elongate member which is rotated about a substantially horizontal axis in use via a gear mechanism. In the illustrated example, the gear mechanism comprises a wheel 10 connected to a rotatable shaft 49 and rotation of wheel 10, caused by a user pushing the horse box 2 across a surface, rotates shaft 49. Teeth 51 provided around a peripheral surface of shaft 49 can engage with complementary teeth 53 provided on an intermediate cog 55 associated with user actuation means. The teeth 53 in turn can engage with complementary teeth provided on a further cog 57 associated with belt 48. With shaft 49, cog 55 and further cog 57 in engagement, rotation of shaft 49 causes rotation of cogs 55, 57, thereby causing rotation of belt 48. Teeth provided on the inner surface of belt 48 engage with the teeth on further cog 57. The cogs are arranged such that rotation of wheels 10 in a forwardly direction causes belt 48 to be driven in an anti-clockwise direction 54 and rotation of wheels 10 in a rearwardly direction causes belt to be driven in a clockwise direction 52.

In order for the user to have the option of selectively actuating the movement means when moving horse box 2, user actuation means are provided. The user actuation means are in the form of an elongate lever 108 having a first end 110 protruding from an outer surface of the housing of the horse box to allow user actuation thereof and a second end 112 provided with intermediate cog 55. Application of a depressive force by a user on end 110 of lever 108 causes cog 55 to move into engagement with shaft 49 and cog 57, thereby transferring rotation of shaft 49 to belt 48. Release of force on lever 108 moves the cog 55 out of engagement with shaft 49 and cog 57, thereby preventing movement of belt 48. Resilient biasing means in the form of a spring 114 is associated with lever 108 to bias lever 108 to the disengaged position. A user is required to overcome the bias of spring 114 in order to engage cog 55 with the adjacent cogs.

It will be appreciated that belt 48 could be driven by powered means if required.

Guide means in the form of a curved slot 58 is defined in rear wall 6 and guides movement of arm member 38 in use. Slot 58 has a first end 74 adjacent the front 18 of the playbase and a second end 76 adjacent the rear 22 of the playbase and defines an arc of a circle, thereby causing arm member 38 to move through an arc of a circle in use.

Doll 16 engages with the movement means in the first position via magnetic attraction provided by magnets located in both the doll and with the movement means. More particularly, a magnet 70 is provided on support means 60 joined to arm member 38 and magnet 70 engages with a magnet 72 located in the back of body portion 24 of doll 16.

Support means 60 is in the form of an elongate post having a first end 62, protruding through slot 58 from front wall 8 and movable therein, and a second end 64 joined to arm member 38. Support means 60 is mounted substantially perpendicular to first end 40 of arm member 38. Magnet 70 is provided on first end 62 of the support means.

First and second magnets 70, 72 engage with each other when moved into close proximity, thereby engaging doll 16 to support means 60. As arm member 38 is pivotally moved relative to rear wall 6 by belt 48, support means 60 slides in slot 58 and causes doll 16 to be moved through an arc of a circle from the first position to the second position. In addition, the arm member 38 includes a slot 66 (see FIG. 1*a*) through which the elongate post extends. The first position of doll 16 typically corresponds to support means 60 being at first end 74 of slot 58 and the second position of doll 16 typically corresponds to the support means 60 being adjacent the second end 76 of slot 58.

Figure 3B:
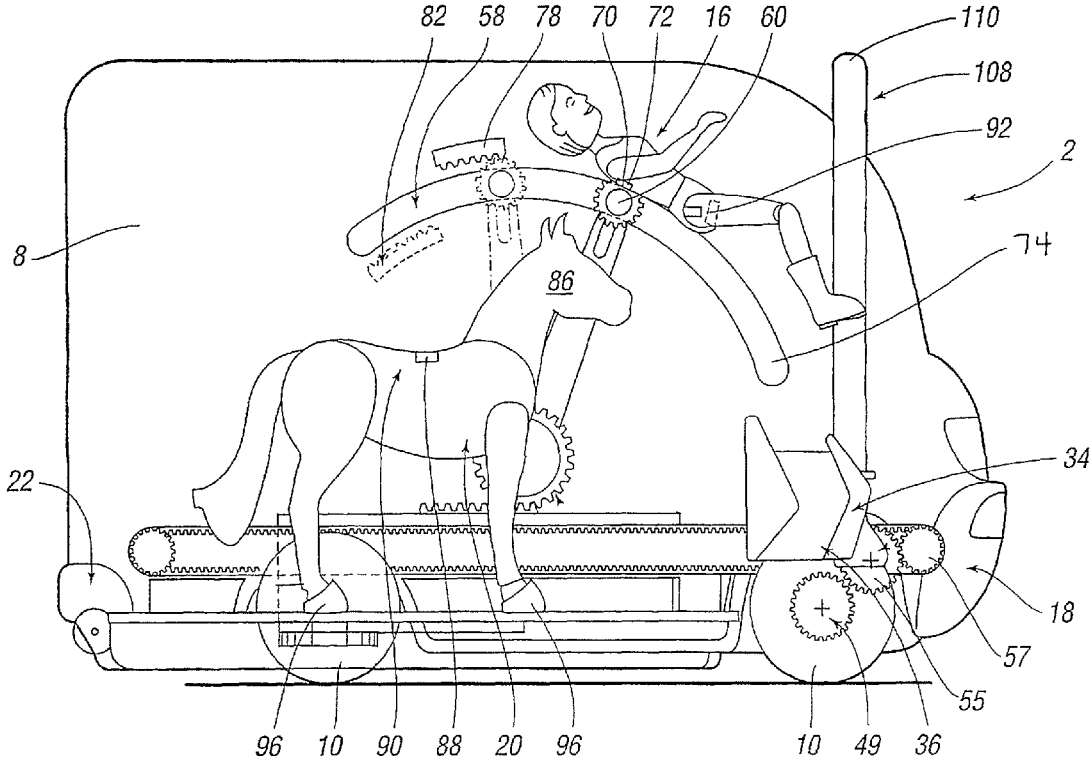
Figure 4:
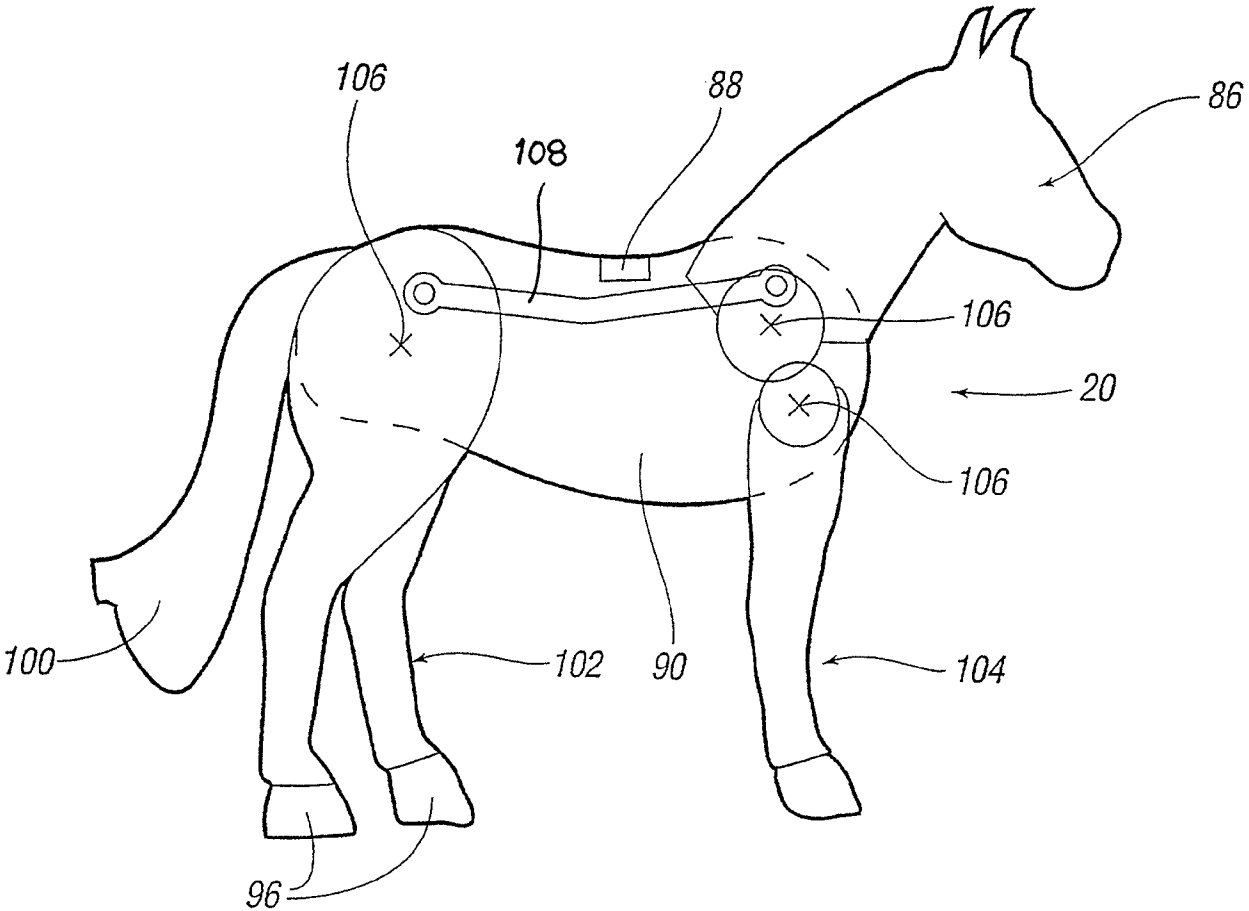
FIG. 4 shows the internal mechanism for a horse shown in FIGS. 3*a* and 3*b*.

In order for doll 16 to be in a correct orientation when brought into engagement with horse 20, a further gear mechanism is provided to change the orientation of doll 16 during movement between the first and second positions. The further gear mechanism includes further gear racks 78 and 80 located adjacent second end 76 above and below guide slot 58 and a cog 68 located on a rear side of arm member 38. Upper gear rack 78 has a plurality of teeth 82 on a lower surface thereof and lower gear rack 80 has a plurality of teeth 82 provided on an upper surface thereof. As arm member 38 is moved towards second end 76, the teeth 84 on cog 68 engage with the complementary teeth 82 on the upper and lower gear racks 78, 80, thereby causing doll 16 to be rotated through approximately 90 degrees. This causes doll 16 to be moved from a substantially horizontal orientation, as shown in FIG. 3*b*, to a substantially vertical orientation, wherein the doll 16 can be seated in an upright position on horse 20 facing front 18 of the playbase and the head 86 of horse 20.

A magnet 88 is provided adjacent an upper surface of body portion 90 of horse 20 at the location where doll 16 is to be brought into engagement in the second position. Magnet 88 typically has a stronger magnetic attraction to doll magnet 92, located in the bottom of body portion 24, than the magnetic attraction between movement means and doll magnets 70 and 72. As such, once doll 16 is moved into the vicinity of horse 20 in the correct orientation, the stronger magnetic attraction between magnets 92 and 88, moves doll 16 into engagement with body portion 90 of horse 20 and releases engagement between magnets 70, 72 of the support means and doll.

Positioning means in the form of pegs 94 and recess 95 are provided on upper surface of base 4 which allow the hooves 96 of horse 20 to be moved into the required second position for doll 16 to be moved into engagement with horse 20. Pegs 94 are associated with the rear hooves of the horse and recess 95 is associated with the front hooves of the horse.

At least an upper surface 116 of base 4 is movable relative to a remaining part of the playbase. Upper surface 116 can be connected to belt 48 via connection 118 adjacent rear wall 6. As such, rotation of belt 48 in a clockwise direction slidably moves upper surface 116 towards rear 22 such that surface 116 eventually protrudes beyond rear 22. Rotation of belt 48 in an anti-clockwise direction slidably moves surface 116 towards front 18.

Movement of upper surface 116 can be used to actuate movement of one or more walls of the housing 3 between closed and open positions. A catch mechanism can be provided at rear 22 of the playbase and includes an arm member 120 pivotably mounted to rear wall 6 via pivot 122. Arm member 120 includes a first lower end 124 protruding towards front 18 and a second upper end 126 protruding towards rear 22. As connection 118 is moved towards rear end 22 via belt 48 and thus upper surface 116 is moved towards rear 22, an angled edge 128 of the connection 118 engages with lower end 124 of the pivot arm 120, causing lower end 124 to pivot in an upwardly direction and causing upper end 126 of the arm 120 to pivot towards rear 22. Movement of upper end 126 towards rear 22 releases a catch 130 which releases one or more the walls of the housing to move the same from a closed position to an open position. The movement of upper end 126 is guided by a slot 134 defined therein movable with respect to a protruding arm 136. Arm member 120 is resiliently biased to lower the lower end 124 via a spring 132 when connection 118 is moved out of engagement with lower end 124.

A rotatable element 98 is also provided on upper surface 116 of base 4 to allow horse 20 to rotate to a required orientation once doll 16 has been positioned on horse 20. Rotatable element 98 can be caused to rotate via any means, such as via electrical means, mechanical means, manually and/or the like. However, in the illustrated embodiment, element 98 rotates on movement of upper surface 116 with respect to base 4.

The horse 20 is further provided with a tail 100 which is connected to the rear of body portion 90, rear legs 102 and front legs 104. The legs 102, 104 are articulated with respect to body portion 90 via joints 106. Connection means in the form of a connection arm 108 connects head 86 and front legs 104 to rear legs 102 and tail 100. With the rear legs 102 located on pegs 94 to maintain the position of the same, pushing tail 100 towards body portion 90 causes front legs 104 and head 86 to lift relative to rear legs 102, thereby allowing horse 20 to be rotated through approximately 180 degrees. Rotation of horse 20 takes place using rotatable element 98. As such, the horse 20 can be moved from a position where the head 86 of the horse faces the front 18 of the horse box to a position where the head 86 faces the rear 22 of the horse box.

Thus, in use, doll 16 can be moved from a position where it appears the doll 16 is driving the horsebox, to a position where doll is mounted on a horse within the horsebox and for the horse to move out of the rear of the horse box. All this takes place on movement of the toy across a floor surface without direct user intervention, thereby increasing the realism of the toy to the user.

In order to reset the mechanism, a user depresses lever 108 and moves the horse box in a backwards direction, thereby rotating wheels 10 and causing belt 48 to be moved in a clockwise direction which resets the movement means.

The apparatus can be formed form any suitable material in any suitable design and/or size, such as plastic, wood, metal and/or the like.

The dimensions of the housing located around the horse box are such that doll 16 can be moved relative thereto with the housing in place without obstruction being caused by the housing.

Other items can be provided with the toy apparatus to increase the realism of the apparatus to a user, such as for example, a grooming kit, saddle, reins, rosettes, horse food and/or the like.

What is claimed is:

1. A toy apparatus, comprising:

a housing including a base, a wall, and a movement mechanism coupled to one of the base or the wall, the housing having a front portion and a rear portion;

a first toy member being releaseably coupled to the movement mechanism, the movement mechanism being configured to move the first toy member relative to the base between a first position proximate to the front portion of the housing and a second position proximate to the rear portion of the housing in response to movement of the housing; and a second toy member proximate to the housing, the first toy member being engageable with the second toy member from above the second toy member when the first toy member is in the second position.

2. The toy apparatus of claim 1, wherein the housing includes at least one wheel coupled to the base, the movement mechanism being coupled to the at least one wheel so that movement of the at least one wheel relative to the base causes the movement mechanism to move the first toy member between the first position and the second position.

3. The toy apparatus of claim 2, wherein movement of the at least one wheel in a first direction causes the movement mechanism to move the first toy member from the first position to the second position and movement of the at least one wheel in a second direction opposite to the first direction causes the movement mechanism to move the first toy member from the second position to the first position.

4. The toy apparatus of claim 1, wherein the wall includes a slot and the movement mechanism includes a post extending through the slot.

5. The toy apparatus of claim 1, wherein the movement mechanism includes a support portion with a coupler and the first toy member includes a coupler, the couplers being configured to releasably couple the first toy member to the support portion.

6. The toy apparatus of claim 1, wherein the housing includes a seat and the first toy member is a toy figure, the toy figure being disposed in the seat when the toy figure is in the first position, the movement mechanism remaining coupled to the toy figure when the toy figure is disposed in the seat.

7. The toy apparatus of claim 1, wherein the movement mechanism includes a first coupler, the second toy member includes a second coupler, and the first toy member includes a third coupler and a fourth coupler, the first toy member being coupled to the movement mechanism via the first coupler and the third coupler when the first toy member is in the first position, the first toy member being coupled to the second toy member via the second coupler and the fourth coupler when the first toy member is in the second position.

8. The toy apparatus of claim 7, wherein first toy member is coupled to the movement mechanism via the first coupler and the third coupler as the movement mechanism moves the first toy member between the first position and the second position.

9. The toy apparatus of claim 1, wherein the first toy member is a toy figure and the second toy member is an animal, the movement mechanism being configured to place the toy figure on the toy animal when the toy figure is in the second position.

10. The toy apparatus of claim 1, wherein the movement mechanism moves the first toy member in an arcuate path above the base.

11. The toy apparatus of claim 1, wherein the housing includes at least one wheel and a gear mechanism that is driven by the rotation of the at least one wheel, the movement mechanism includes a support arm movable between a first position and a second position, and the toy apparatus further comprises:

an actuator mechanism coupled to the housing and movable relative thereto, the actuator mechanism being movable between a first position in which it is disengaged from the gear mechanism and a second position in which it is engaged with the gear mechanism, the support arm moves between its first position and its second position when the actuator mechanism is in its second position and the at least one wheel moves and the support arm does not move when the actuator mechanism is in its first position.

12. The toy apparatus of claim 11, wherein the first toy member is a toy figure that is releaseably coupled to the support arm.

13. The toy apparatus of claim 1, wherein the housing includes an engagement mechanism that changes the orientation of the first toy member relative to the base as the first toy member is moved between its first position and its second position.

14. The toy apparatus of claim 13, wherein the engagement mechanism includes at least one rack with teeth configured to engage teeth on the movement mechanism as the movement mechanism moves relative to the base.

15. The toy apparatus of claim 14, wherein the wall includes a guide slot and the engagement mechanism is disposed proximate to the guide slot.

16. A toy apparatus, comprising:

a housing including a base and a wall, the housing being configured to move along a support surface;

a movement mechanism coupled to the housing, the movement mechanism including a support portion that is moved relative to the wall between a first position and a second position spaced apart from the first position in response to movement of the housing along the support surface;

a toy figure releasably coupled to the movement mechanism, the toy figure being movable between the first position and the second position, the orientation of the toy figure relative to the base changing between the first position and the second position; and a toy member proximate to the housing, the toy figure being engageable with the toy member from above the toy member when the toy figure is in the second position.

17. The toy apparatus of claim 16, further comprising:

at least one wheel coupled to the base, the at least one wheel being engageable with the movement mechanism, the movement mechanism moving the toy figure between the first position near a front of the housing and the second position near a rear of the housing when the at least one wheel moves relative to the base, the orientation of the toy figure in the first position being the same as the orientation of the toy figure in the second position.

18. A toy apparatus, comprising:

a housing configured to be moved along a support surface;

a support arm coupled to the housing and to a drive mechanism, the drive mechanism moving relative to the housing when the housing moves along a support surface, the support arm being moved between a first position and a second position when the drive mechanism moves relative to the housing, the support arm including a first coupler; and a toy figure including a second coupler configured to cooperate with the first coupler, the toy figure being releasably coupled to the support arm via the first coupler and the second coupler, the toy figure being disposed in a first orientation when the toy figure and the support arm are in the first position, the toy figure being disposed in the first orientation when the toy figure and the support arm are in the second position, the toy figure being disposed in a second orientation different from the first orientation as the support arm and toy figure move between the first position and the second position.

19. The toy apparatus of claim 18, wherein the housing includes a guide and an engagement member disposed proximate to the guide, the guide defining the movement of the support arm between the first position and the second position, the engagement member including teeth configured to engage the support arm and change the orientation of the toy figure relative to the housing.

20. The toy apparatus of claim 19, wherein the housing includes a wall including the guide formed therein, the support arm is pivotally coupled to a side of the wall, and the engagement member is fixedly coupled to the side of the wall.

21. The toy apparatus of claim 18, further comprising:

a toy member proximate to the housing, the toy figure being engageable with the toy member from above the toy member when the toy figure is in the second position.

* * * * *